US006139188A

United States Patent [19]

Marzano

[11] Patent Number: 6,139,188

[45] Date of Patent: Oct. 31, 2000

[54] INSULATED TRANSIT BAG

[76] Inventor: Domenico Marzano, 25 Whiffletree Ct., Woodbridge, Ontario, Canada, L4L 3K1

[21] Appl. No.: 09/305,776

[22] Filed: Apr. 29, 1999

[51] Int. Cl.[7] ..... B65D 30/08

[52] U.S. Cl. ..... 383/110; 383/3; 383/61; 383/63; 383/109; 206/522

[58] Field of Search ..... 383/3, 61, 63, 383/109, 110; 206/522

[56] References Cited

U.S. PATENT DOCUMENTS

| | | | |
|---|---|---|---|
| 4,465,188 | 8/1984 | Soroka et al. | 383/3 X |
| 4,521,910 | 6/1985 | Keppel et al. | 383/110 X |
| 4,872,558 | 10/1989 | Pharo | 383/3 X |
| 5,595,320 | 1/1997 | Aghassipour | 383/110 X |

FOREIGN PATENT DOCUMENTS

| | | | |
|---|---|---|---|
| 0 085 534 | 8/1983 | European Pat. Off. | 383/110 |
| 2 228 208 | 1/1973 | Germany | 383/110 |
| 28 53 061 | 6/1980 | Germany | 383/110 |
| 42 19 258 | 10/1993 | Germany | 206/522 |
| 164528 | 9/1958 | Sweden | 383/110 |

*Primary Examiner*—Jes F. Pascua
*Attorney, Agent, or Firm*—Anthony Asquith & Co.

[57] ABSTRACT

The insulated transit bag is made from bubble-wrap material, bonded to aluminum foil. The material is doubled-over, folded, and heat welded to form sealed seams. The bag is used for transporting heat-sensitive medicines etc.

16 Claims, 12 Drawing Sheets

INSULATED TRANSIT BAG

This invention relates to transit bags or pouches for containing special contents, and particularly temperature-sensitive medicines, for transport of the contents by mail, or by courier.

BACKGROUND TO THE INVENTION

Many medicines lose their efficacy if kept for more than a few hours at the wrong temperature. Insulin, for example, deteriorates if allowed to rise above about 15 deg C. for more than an hour or two. As a result, insulin cannot be sent through the post. Generally, insulin cannot even be sent by overnight-courier.

Special medical courier services are available, but they are inordinately expensive for everyday items. Persons who have need of temperature-sensitive medications, therefore, when travelling, have to have the medications made up by a local pharmacist. Such persons would much prefer their prescriptions to be made up by their home pharmacist, if only there were an inexpensive means for transporting the prescriptions.

The invention is aimed at providing a transit bag that can contain a prescription quantity of insulin, and which is sufficiently thermally insulated to enable the insulin to be maintained at a temperature of less than 15 deg C., during transit, for a period of about two days. The invention is aimed at providing a bag which is also light in weight, and inexpensive to manufacture.

As will be apparent from the descriptions herein, the bag can be designed for the transport of items other than insulin prescriptions.

GENERAL FEATURES OF THE INVENTION

The material from which the bag of the invention is made is bubble-wrap sheet. The invention also uses a composite or lamination of a plastic bubblewrap sheet and aluminum foil. The aluminum foil is bonded or welded to the bubbles of the plastic bubblewrap sheet.

The sheets are arranged to form bags, which are arranged one inside the other, with the aluminum of the outer composite sheet facing outside. The composite sheets are welded or otherwise secured together at the edges to form a pouch, and an open mouth is left for inserting the temperature-sensitive contents. The mouth can be welded closed, or otherwise closed, after the contents are inserted.

The bubblewrap material provides excellent thermal insulation, in that air is trapped inside the bubbles. Preferably also, the spaces between the bubbles are also confined, and the air is trapped in those spaces too. (Still air is, of course, one of the best insulators known.) The aluminum foil provides protection against radiant heat transfer. The aluminum foil also provides structural robustness to the outside of the bag, as a protection against the inevitable minor knocks that occur during transport and handling. It may be noted that although the aluminum is thin, it is structurally well-supported, because the bubblewrap material provides many surfaces that extend at right-angles to the plane of the foil.

As will be explained, the bag can be designed to be inflated, after the contents are inserted, which provides good structural rigidity, good shock-absorption, and improved thermal insulation. Even so, the bag is light in weight (which of course is important in a transportation bag) and inexpensive to manufacture and use.

Preferably, the inner bag has an inside layer which is of relatively strong material, which may be plastic, or aluminum foil, and provides a robust surface against which the contents can bear directly. The inside of the bag, though mechanically robust, generally does not need to be liquid-tight, because liquid medicines, and other liquids being transported, would in any case be placed in a liquid-tight sachet or other suitable container prior to being placed in the bag. On the other hand, by configuring the bubble material in different ways, as will be explained, the inside of the bag can be liquid-tight if desired.

The bag is not (quite) light-tight. However, the bag provides excellent protection against, for example, U/V and other radiation to which some items can be sensitive. Writable CDs, for example, which can be sensitive to U/V light, can usefully be transported in the designs of transit bag as described herein.

In fact, the use of the bag, with its metal shielding, might make it difficult for authorities to detect some illegal substances. Where that is a possibility, bags containing approved contents might be provided with pre-cleared-customs identification. The bag as described herein is suitable for this function, in that it is easy for the designer to ensure that any tampering with the sealed bag, either though the metal itself, or through the sealed edges, would inevitably be apparent.

Bubble-wrap plastic film material is of course commonly available. Bubble wrap material laminated with aluminum foil also is available; under the brand name Ayr-Foil, for example.

Bubblewrap material has been conventionally used for making transit bags. For example, Jiffy Bags (TM) have stiff paper covers adhered to a bubble layer, and are used as postage envelopes. The bags are crimped at the edges, in order to form the mechanical structure of the bag. Such bags are however just one single layer of bubble-wrap, inside the paper cover; they have not been designed to be thermally insulative.

Bubble-wrap material is popular for many uses. It can be formed into a closable bag. It is not too bulky. It is inexpensive. But it is recognised that just one bag (i.e. just one thickness) would not do, thermally. The main property which has made bubble wrap popular has been its shock absorbing properties, which make it highly suitable as a packaging material.

Bubble wrap on its own does not lend itself to the function of providing thermal insulation. The spaces between the bubbles offer very little insulation. Even if two layers of bubblewrap are provided, further steps are still needed to ensure the non-bubble areas of adjacent layers are spaced apart from each other. If the non-bubble areas touch, there is very little insulation. It is recognised that if the layers were just laid flat over each other, several layers would be needed to ensure freedom from any areas where the non-bubble areas might touch. Bubble wrap material is quite thick, so several layers quickly becomes cumbersome (in volume, if not in weight).

So, even providing two bubblewrap bags, one inside the other, and placing the article inside the inner bag, cannot be expected to provide a thermal insulation performance that will ensure the contents can remain at say 15 deg C. for two days, during transit It is recognised in the invention that what is needed is to provide two sealed bags, and also to seal the space between the two bags, and also to provide an outer cover, preferably of aluminum foil. Preferably the space between the two bags is inflated, i.e. pressurised, prior to sealing.

With that construction, the excellent thermal insulation properties of bubble wrap material can now be exploited.

The invention is aimed at providing a good compromise between volumetric bulk and insulative effectiveness. The design of transit bag as described herein can be expected to keep medicines etc. at several degrees below room temperature, during transit by couriers (or even by mail), even in summer, for at least two days, and usually for as many as four days. Just one layer of bubble wrap would not work; several layers wrapped and overlapped might do, but that would be too bulky.

Preferably, the sealed space between the two bags should be inflated prior to sealing. Inflating the space means the outer bag is stretched taut, which can increase the resistance to mechanical indentation. Inflation is a useful measure not only from the mechanical protection standpoint, to prevent the contents of the bag from being damaged, but also from a thermal performance standpoint, to prevent the bubbles of the bubblewrap material from being collapsed or damaged, and to prevent the two bags from touching (at least, over much of their areas), which would probably increase heat transfer between the bags.

DETAILED DESCRIPTION OF PREFERRED EMBODIMENTS

By way of further explanation of the invention, exemplary embodiments of the invention will now be described with reference to the accompanying drawings, in which:

FIG. 1 is a pictorial view of a thermal bag that embodies the invention, the bag being shown open and ready to receive contents;

FIG. 2*a* is a diagram of the configuration of a sheet that is a composite of the bubble-wrap material and aluminum foil, from which the bag of FIG. 1 is made;

FIG. 2*b* is a diagram of the configuration of an alternative composite;

FIG. 2*c* is a diagram of the configuration of an alternative composite;

Figure 1:
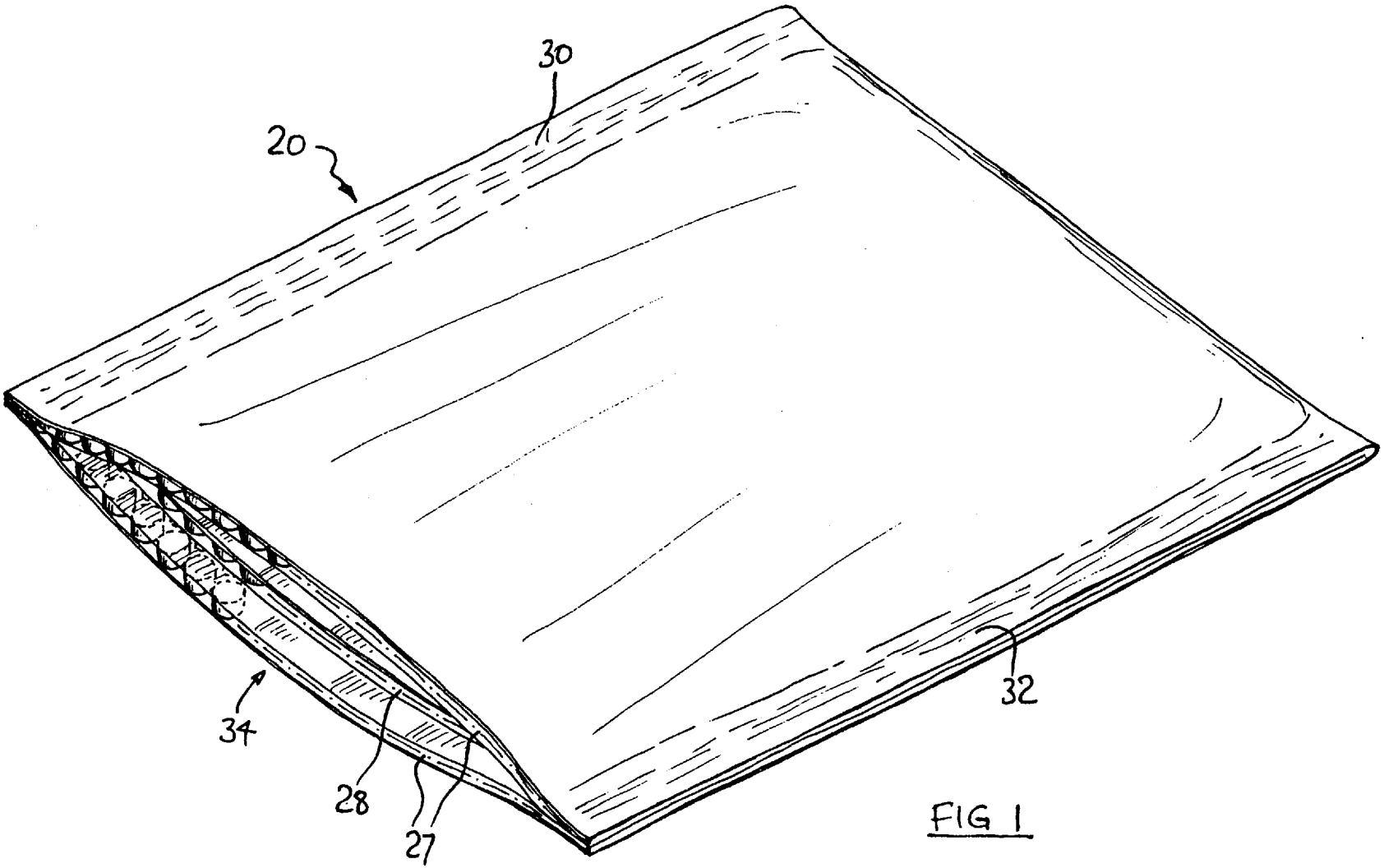
Figure 5:
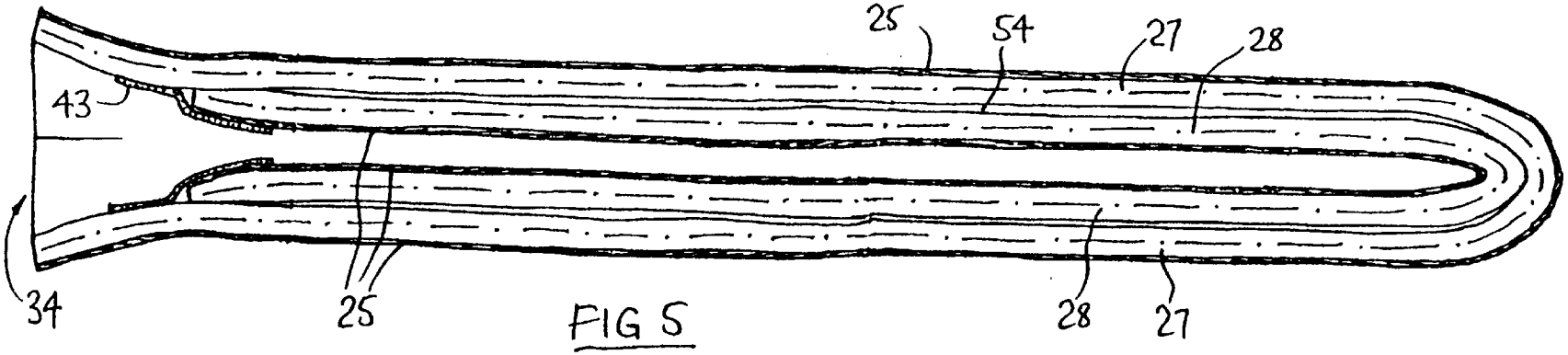
FIG. 5 is a cross-section on line 5—5 of FIG. 1, and shows the bag at a subsequent stage of manufacture.
Figures 7A, 7B:
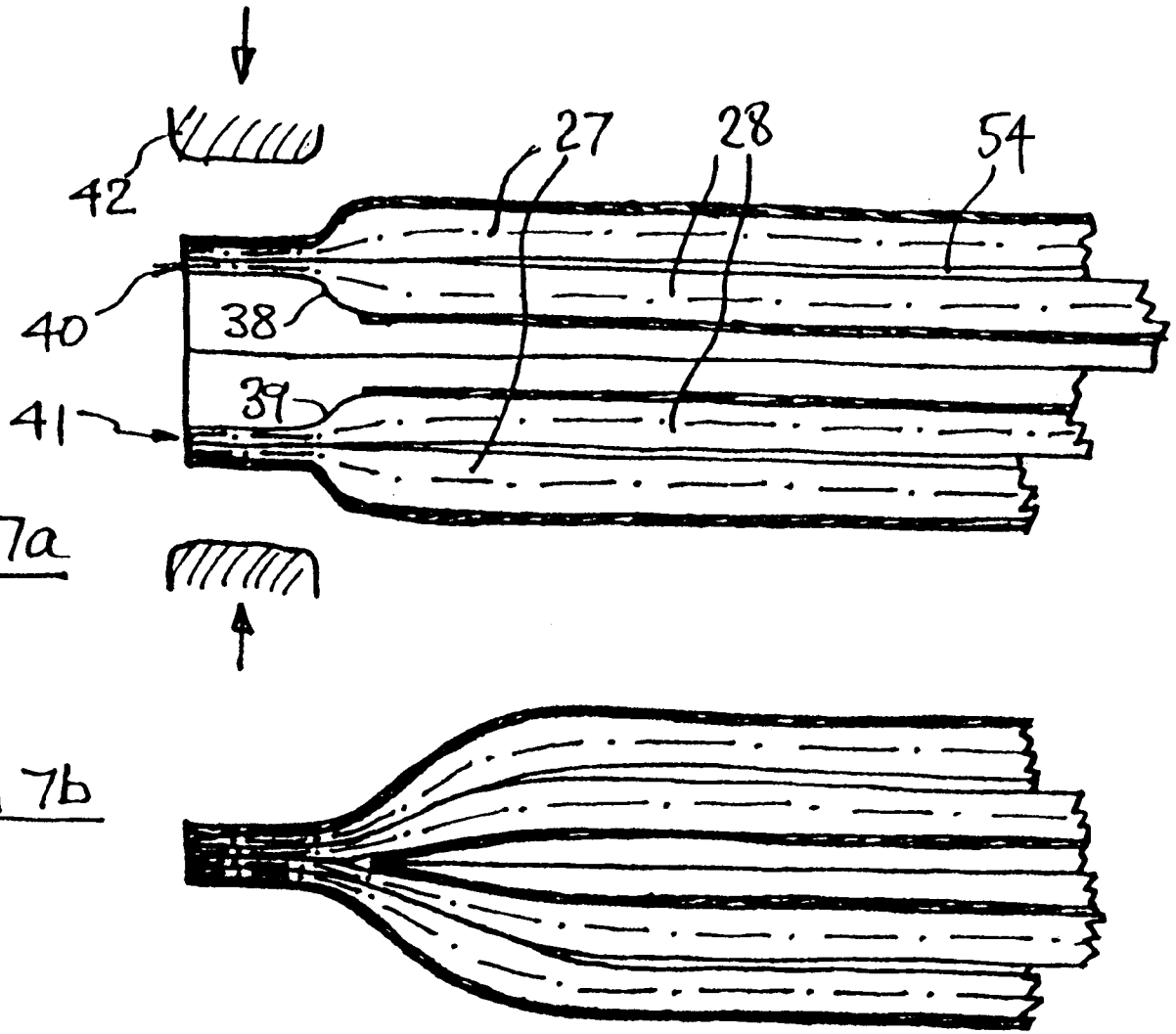
Figure 8:
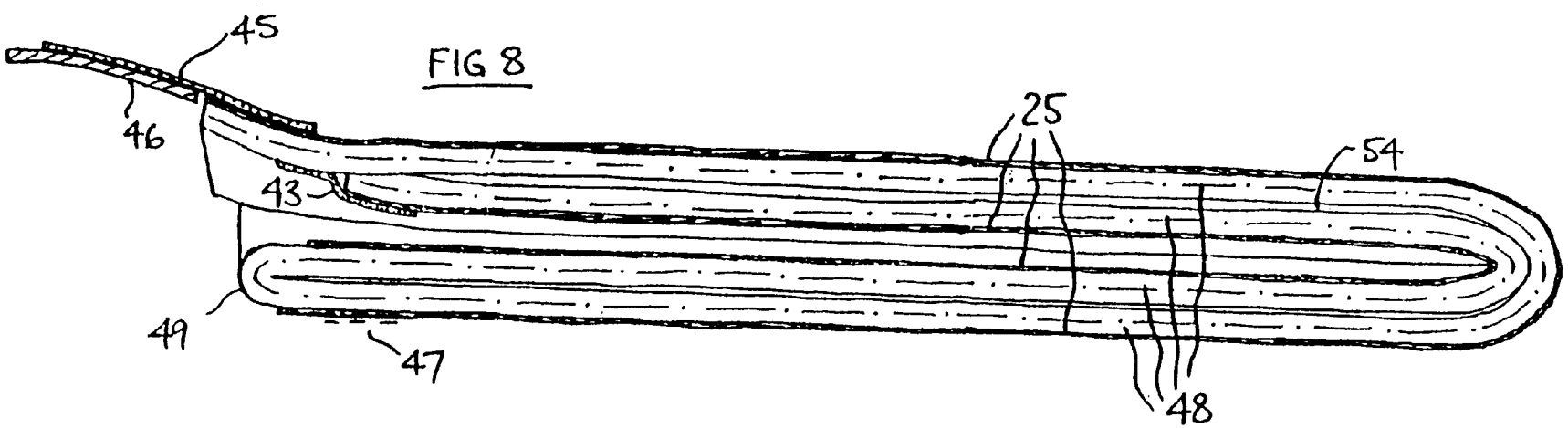
Figure 9:
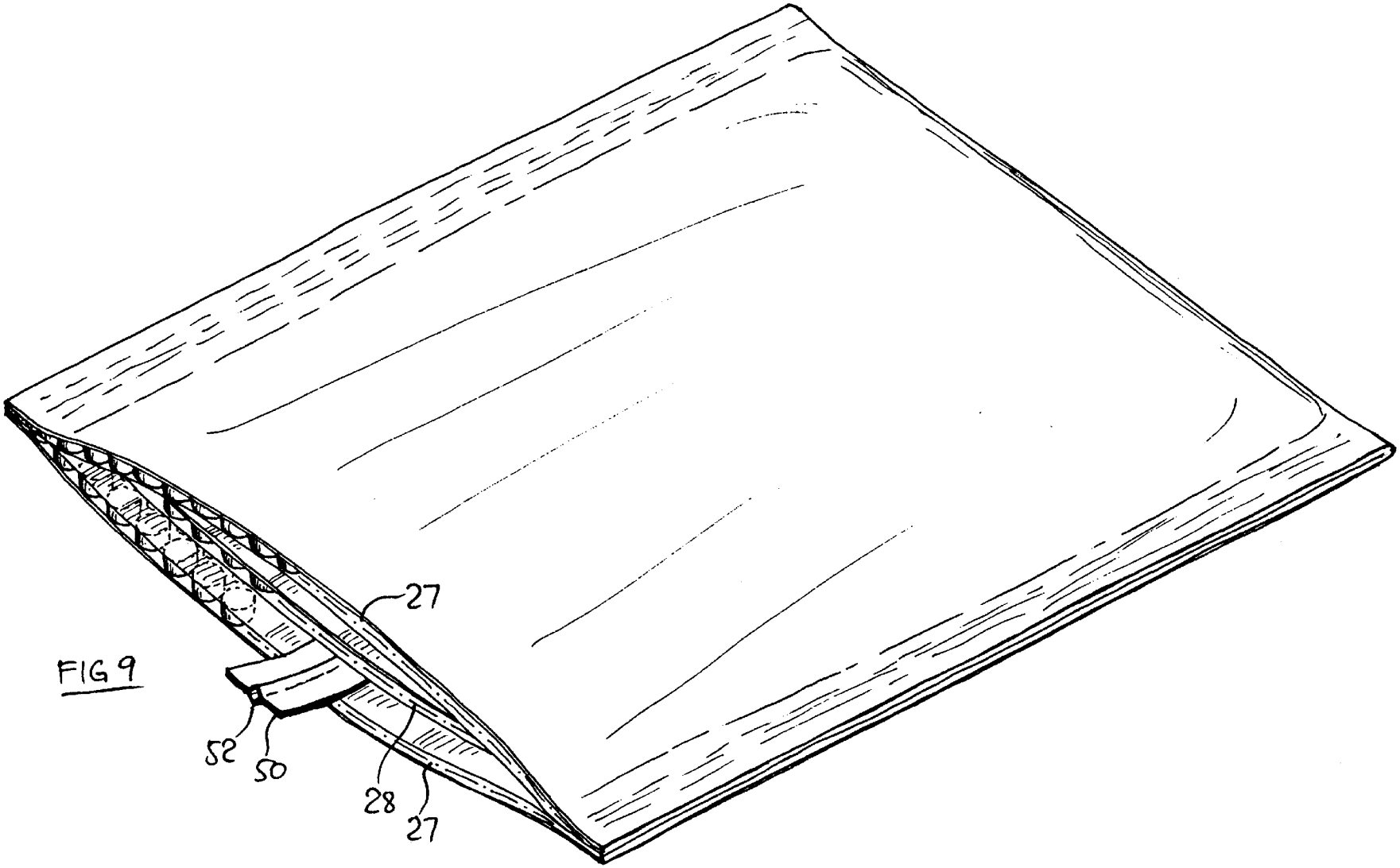
Figure 10A:
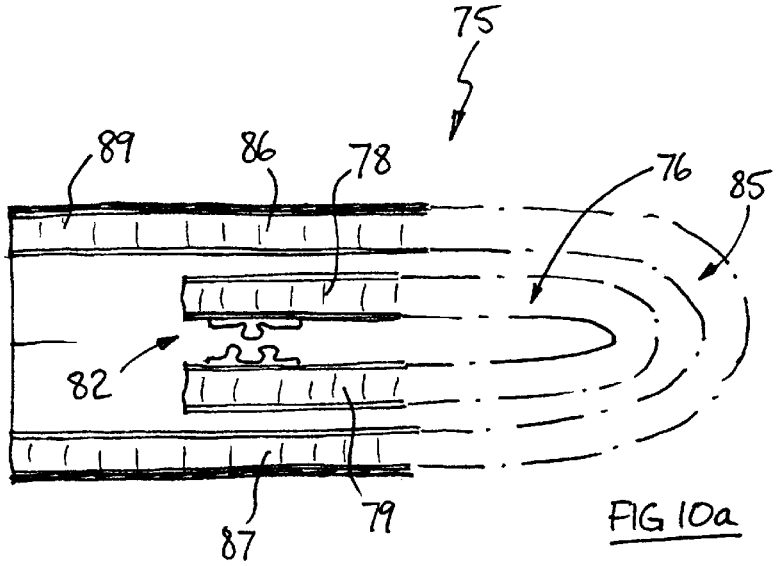

FIG. 7*a* is a cross-sectional view, showing the mouth of the second bag;

FIG. 7*b* is the same view as FIG. 7*a,* and shows the bag in a fully closed condition;

FIG. 8 is the same view as FIG. 5 of a third bag that embodies the invention;

FIG. 9 is the same view as FIG. 1 of a fourth bag that embodies the invention;

FIGS. 10*a,* 10*b,* 10*c* are cross-sectional views showing the mouth area of a further transit bag.

The apparatuses shown in the accompanying drawings and described below are examples which embody the invention. It should be noted that the scope of the invention is defined by the accompanying claims, and not necessarily by specific features of exemplary embodiments.

The bag 20 shown in FIG. 1 is suitable for the containment, during transportation, of thermally-sensitive items, such as medicines and perishable materials.

Figure 2A:
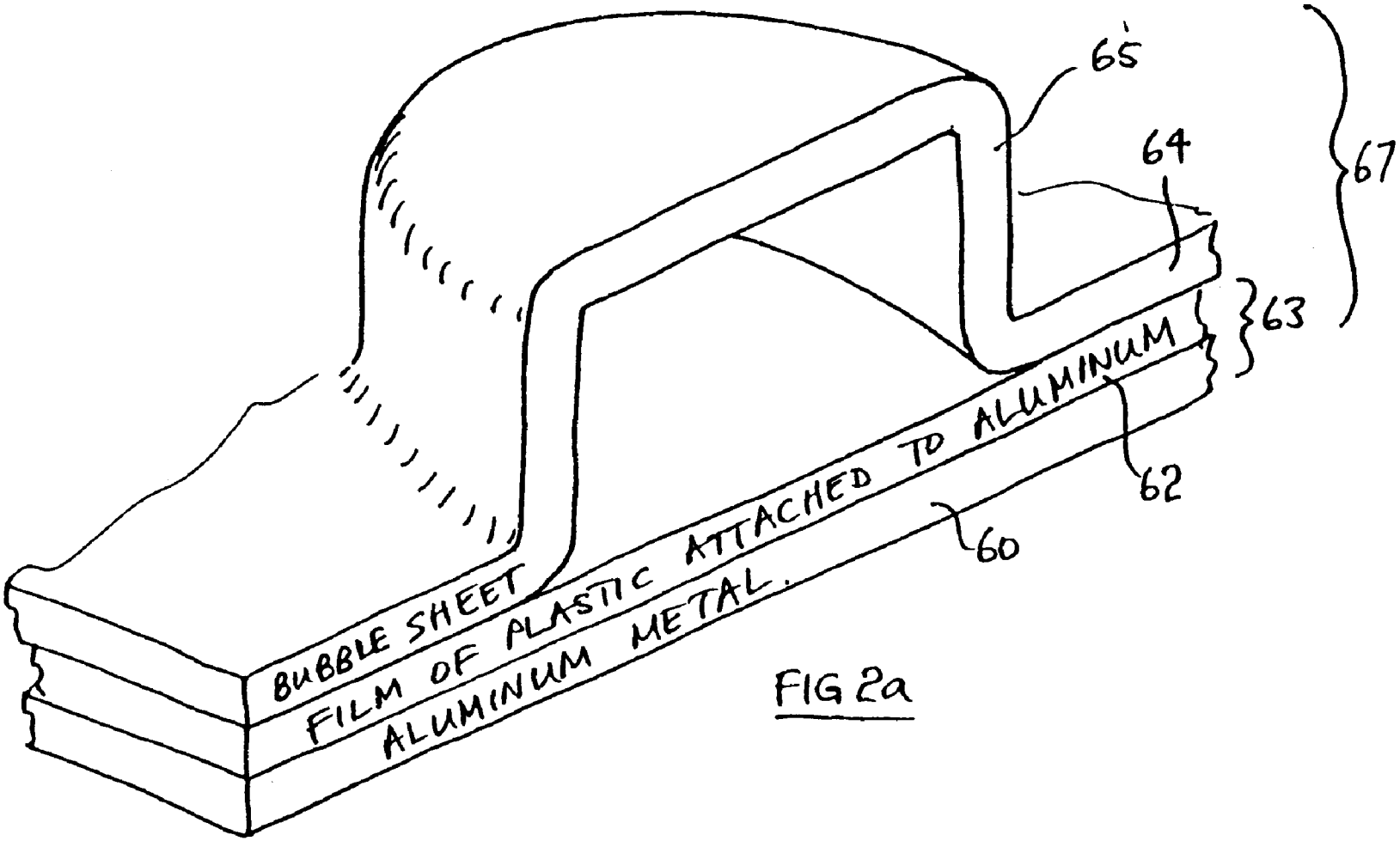

The material from which the bag is made is shown in more detail in FIGS. 2*a,* 2*b,* 2*c.* The material itself is conventional, and is based on the common polyethylene bubble-wrap material. In FIG. 2*a,* a layer 60 of aluminum foil, which is typically about 0.002 inches thick, is provided with a film 62 of polyethylene, which is about 0.003 inches thick. The plastic film 62 is in intimate bonded adherence to the aluminum foil layer 60.

The combined plastic-aluminum sheet 63 is welded to a bubble sheet 64 of plastic film, by passing the bubble sheet and the plastic-aluminum sheet between rollers, under such conditions of heat and pressure as will cause welding. The bubbles 65 are formed in that the roller against which the bubble sheet 64 contacts is provided with many recesses, each with a vacuum supply, into which the film of the bubble sheet is drawn. Composite sheet 67 is the result of welding the plastic-aluminum sheet 63 to the bubble sheet 64.

The bubbles 65 have a diameter of about 0.4 inches, and are arranged in regularly-pitched rows.

Figure 2B:
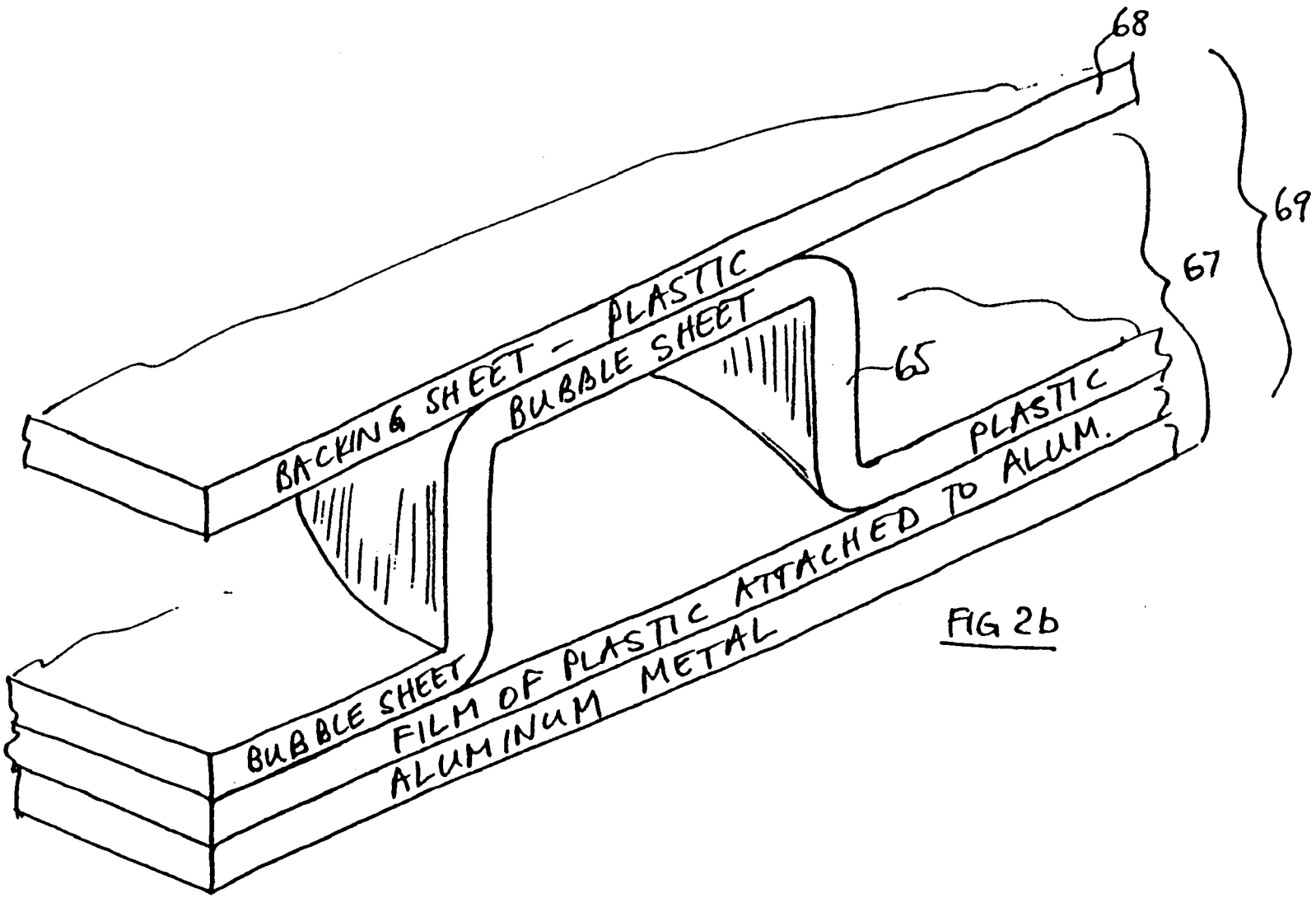

In FIG. 2*b,* a composite sheet like the sheet 67 of FIG. 2*a* is provided with a backing sheet 68 of plastic film. The backing sheet 68 is welded to the tops of the bubbles 65, again by passing the composite sheet 67 and the backing sheet 68 between rollers under conditions of heat and pressure. Now, the backing sheet 68 is compressed between the roller and the tops of the bubbles 65, whereby some skill is needed to ensure that the backing sheet 68 adheres properly to the tops of the bubbles, but such skill is within the competency of a skilled manufacturer.

The final composite sheet 69 in FIG. 2*b* can be used in a bag that embodies the invention, as can the composite sheet 67 of FIG. 2*a.*

Figure 2C:
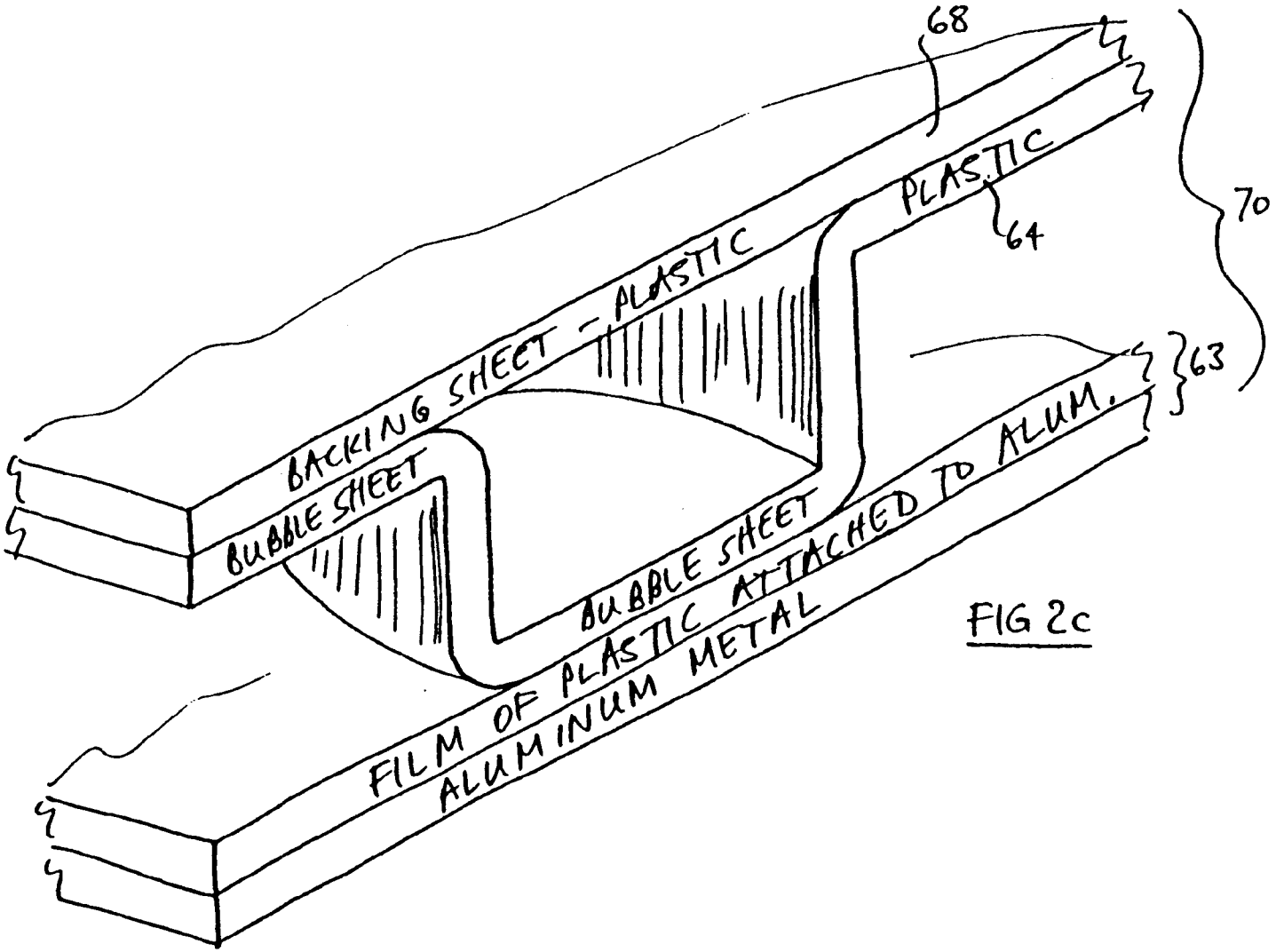

FIG. 2*c* shows another variation. Here, a backing sheet 68 and a bubble sheet 64 are pressed together bypassing the two films between rollers, under conditions of heat and pressure, as described. Then, the plastic-aluminum sheet 63 is pressed onto the tops of the bubbles, again as described. The resulting composite sheet 70 can also be used in a bag that embodies the invention.

Other variations to the manner of arranging the sheets are also possible. For example, two of the composite sheets as shown in FIG. 2*a* can be pressed together, bubble-to-bubble, to form a single bonded sheet.

Figure 3:
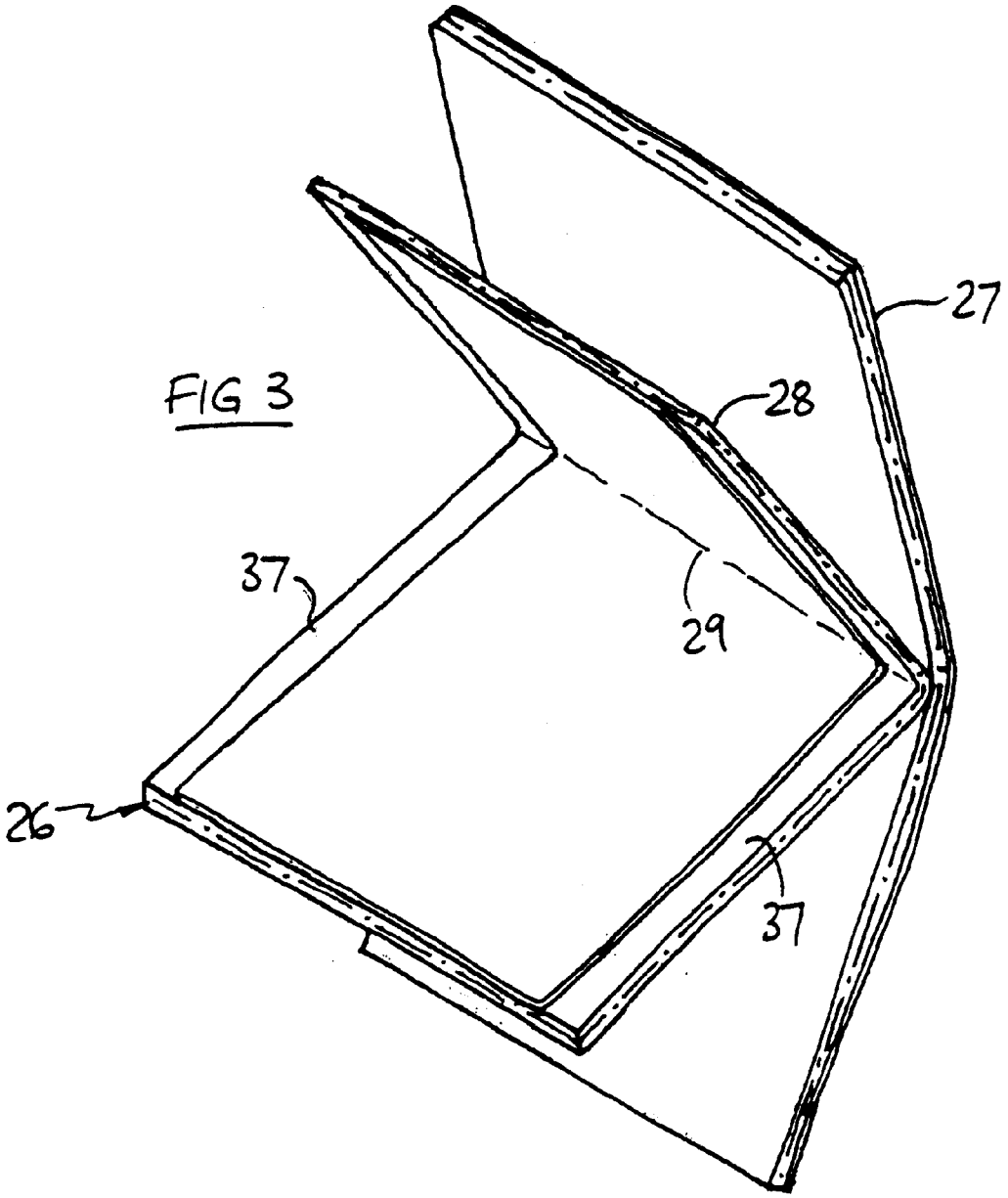
FIG. 3 is a pictorial view of some components of the bag, shown at a stage during manufacture.

As shown in FIG. 3, the bag 20 is made from an outer composite sheet 27 and an inner composite sheet 28. Whether the composite sheet is the sheet 67 of FIG. 2*a,* the sheet 69 of FIG. 2*b,* or the sheet 70 of FIG. 2*c,* or some other variation, generally the designer will prefer to use the same type of sheet throughout. In making the bag, the outer composite sheet 27 and the inner composite sheet 28 are assembled with the respective plastic base layer 23 sides of the sheets together, i.e. with the aluminum foil 25 sides of the sheets outermost.

A crease 29 is made in the outer and inner composite sheets 27,28. The crease 29 is folded over, until all four thicknesses of the sheets overlie each other.

Figure 4:
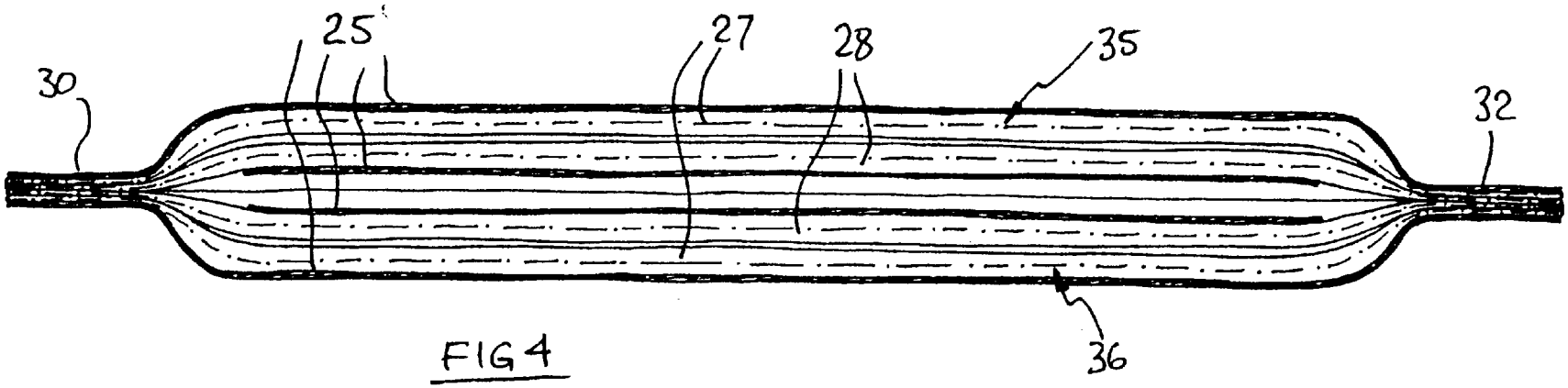
FIG. 4 is a cross-section on line 4—4 of FIG. 1.

The composite sheets are welded together along the left and right side margins 30,32, as shown in FIG. 4, thus forming the sheets into a rectangular pouch or bag, which is closed on three edges, and has an open mouth 34 on the fourth edge. The top thickness 35 of the bag comprises half of the inner composite sheet 28 and half of the outer composite sheet 27, and the bottom thickness 36 of the bag comprises the other halves of the composite sheets. The aluminum foil of the outer composite sheet faces outwards, and the aluminum foil on the inner composite sheet faces inwards and lines the inside of the bag.

It may be noted from the drawings that the aluminum foil 25 of the inner composite sheet 28 does not extend to the edges of the bubbles 24 of the inner sheet. The aluminum foil of the inner sheet is short, and leaves bubble-exposed margins 37 to left and right of the inner composite sheet. In respect of the outer composite sheet 27, there are no bubble-exposed margins, but rather the aluminum foil 25 of the outer sheet covers the whole area of the bubbles of the outer sheet, and is co-extensive with the base layer 23 of the outer composite sheet.

Because the aluminum foil 25 of the top and bottom halves of the inner sheet 28 does not extend to the edge of the inner sheet, when the left and right margins 30,32 of the top and bottom thicknesses 35,36 of the bag are squeezed together, it is the respective plastic base layers 23 of the inner and outer composite sheets 27,28 that come together in direct contact (FIG. 4). Thus, at the margins 30,32, the aluminum is not present between the sheets, whereby the plastic of the inner and outer sheets of the top and bottom thickness of the bag can all be welded together.

The side margins of the bag are sealed and secured as described above. The mouth of the bag 20 is also sealed and secured, in a manner as will now be described.

In the bag depicted in FIG. 1, the inner composite sheet 28 has been cut shorter (lengthwise) than the outer composite sheet 27, and, as shown in FIG. 5, the end-edges of the inner sheet are secured to the outer sheet by means of adhesive tape 43. (The tape 43 is not shown in FIG. 1.) To seal the bag after the contents have been inserted, the top and bottom portions of the outer layer can be pressed and welded together. As shown in FIG. 5, the adhesive tape 43 is provided to guide the items to be placed in the bag into the correct place: if the tape were omitted, a careless person might insert the item between the inner and outer composite sheets, rather than between the two halves of the inner composite sheet.

Figure 6:
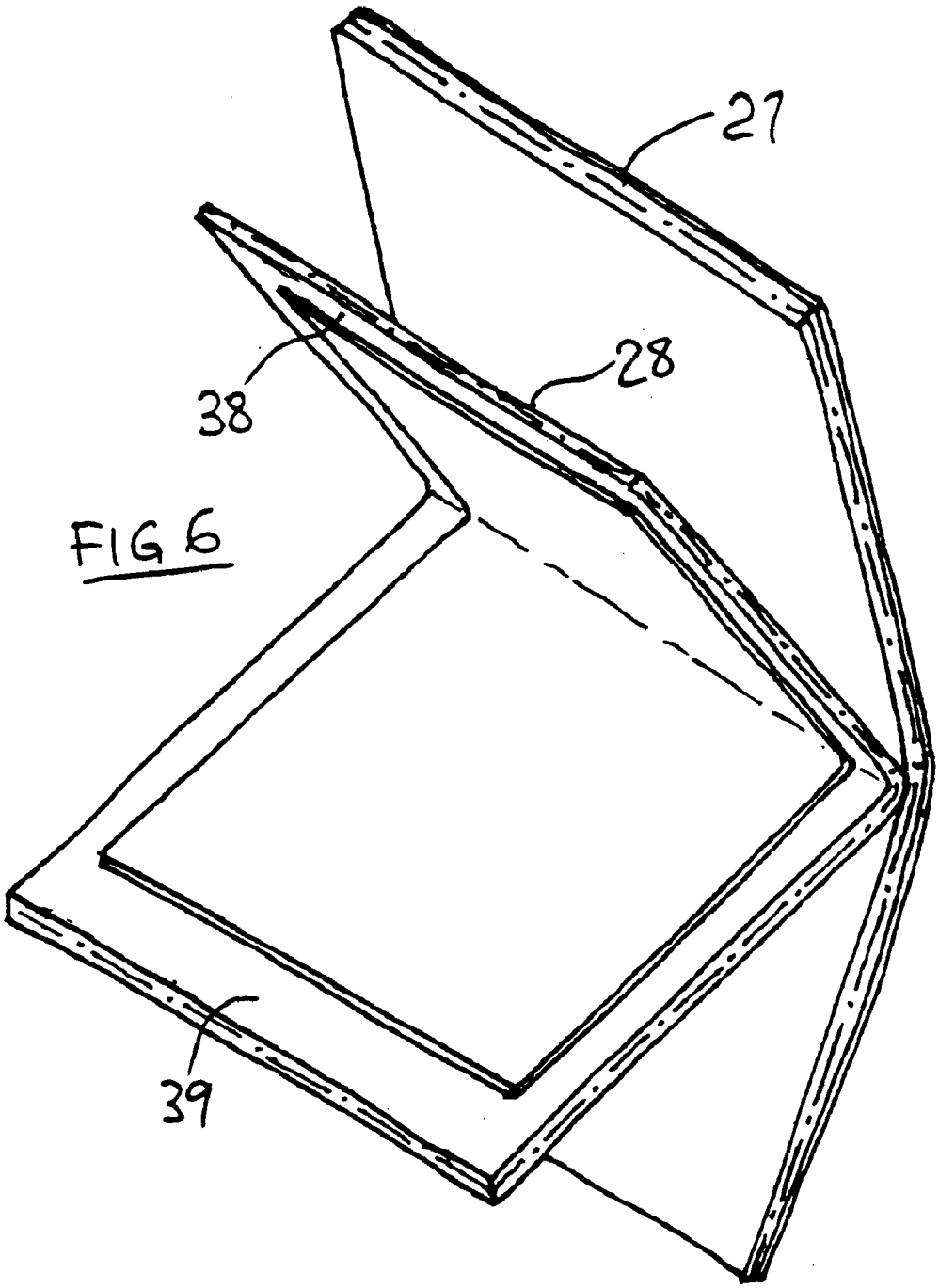
FIG. 6 is a pictorial view similar to FIG. 3, of some components of a second bag that embodies the invention.

FIGS. 6,7*a* show an alternative arrangement of the sheets at the mouth of the bag. As shown in FIG. 6, the aluminum foil is absent from the ends of the inner composite sheet, thus exposing the bubbles at end-margins 38,39, just as the bubbles at the side margins are exposed. As shown in FIG. 7*a,* the inner and outer sheets 28,27 of the top thickness 35 are squeezed and pre-welded together, at 40, during manufacture of the bag, as are the inner and outer sheets 28,27 of the bottom thickness 36, at 41. Again, it may be noted that the aluminum foil 25 stops short, and leaves end margins 38,39 of exposed bubbles of the inner sheet 28.

After the contents have been inserted into the bag, the bag is sealed. This is done by pressing the pre-welded portions 40,41 between heated bars 42, which welds the then-touching plastic together. As shown in FIG. 7*b,* after that, the mouth of the bag lies sealed in much the same manner as the side margins of the bag.

In the alternative shown in FIG. 8, a piece of adhesive tape 45 is provided for sealing the mouth of the bag shut after the contents have been inserted. The tape 45 is provided with a peel-off backing strip 46, which is removed just before the tape 45 is folded over and pressed against the aluminum foil 25 in the area 47 of the bottom 36 of the bag. It may be noted that flat aluminum foil is well suited to being adhered to by the tape.

Also, in FIG. 8, it may be noted that the bag is made from a single composite sheet 48, which is doubled and folded over, as shown, to form the inner and outer sheets 28,27 of the top and bottom thicknesses 35,36 of the bag. In this case, the aluminum foil 25 is discontinuous, in that the foil does not extend over the bottom lip 49 of the mouth of the bag.

It will be noted that, in the bags as illustrated, the aluminum foil forming the inside lining of the bag is physically isolated from the aluminum foil forming the outside of the bag. Not only that, but the inside foil is everywhere kept away from the areas where the sheets are squeezed together, and in fact the inner foil is everywhere separated from the outer foil by two full thicknesses of the un-compressed plastic bubblewrap material.

Removing the inside aluminum foil from the margins is advantageous for two reasons: first, it means the plastic components of the sheets are in direct touching contact at the margins, whereby the plastic components can be welded together at the margins; and second, it allows the inside and outside aluminum foils to be kept everywhere well spaced apart. If the inside and outside foils were allowed to touch, the resulting capacity to conduct heat would destroy much of the insulative nature of the bag. Indeed, if the inside and outside foils were allowed even to be close together (if, for example, the inside and outside foils were separated only by squeezed bubbles), it can be expected that the insulative properties would decline considerably. As shown in the drawings, the inner and outer foils are kept spaced apart everywhere by two thicknesses of un-crushed bubbles.

FIG. 9 shows a means for enabling the space between the inner and outer composite sheets to be inflated. The inflating means 50 is made up from two sheets of plain plastic film, which are bonded together over most of their area, except for an intermediate narrow strip 52. The inflating means 50 is trapped between the inner and outer composite layers 28,27, as shown in FIG. 9. The un-bonded strip 52 serves as a tube, through which air can be injected into the space 54 between the inner and outer sheets, after the items have been placed in the bag. The inflating means 50 can be withdrawn, prior to sealing the mouth of the bag, or the inflating means can be tucked over, and left in place.

Inflating the space 54 between the base layers of the inner and outer sheets provides a degree of extra packing in the bag, without extra weight or cost. The extra air also provides better insulation. Plastic being slightly permeable to air, only a very low inflation pressure can be sustained over time—but the bag is intended for short-term packaging.

When the bag is used by a pharmacist, the pharmacist can affix an information label to the outside surface of the bag: it may be noted that the outside of the bag comprises aluminum foil, not plastic bubbles, and so it is easy to fix adhesive labels thereto. It is the intention that the bag as described herein will be placed in a further envelope, for example in a conventional (cardboard) courier-envelope. Alternatively, the bag as described can be utilised itself as the complete envelope.

The bag as described herein, especially when welded closed, provides a tamper-proof enclosure, in the sense that if the contents are tampered with, that fact is obvious to the recipient. Also, a slip of temperature-sensitive material can be inserted into the bag, which would indicate to the recipient if the temperature inside the bag had risen above (or fallen below) that required to ensure efficacy of the contents.

FIGS. 10*a,* 10*b,* 10*c* show another manner of sealing a transit-bag 75.

The inner-bag 76 comprises a top sheet 78 and a bottom sheet 79. A press-lock fastener 80 is secured inside the mouth 82 of the inner bag 76. The press-lock fastener comprises a key-strip 83 and a lock strip 84, which are secured (welded or glued) one inside the top sheet 78 and the other inside the bottom sheet 79. the press-lock fastener, i.e. the strips that comprise it, are commonly available as a proprietary item.

The top sheet 86 and the bottom sheet 87 of the outer bag 85 are cut with extensions 89, which protrude a little way beyond the end of the inner-bag 76.

Figure 10B:
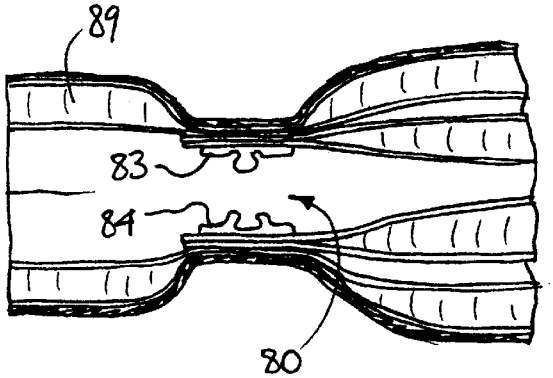

FIG. 10*a* shows the components during a preliminary stage of manufacture, the bags being placed one inside the other. FIG. 10*b* shows the components when the top sheet 86 of the outer bag and the top sheet 78 of the inner bag have been compressed and sealed together; and when the bottom sheet 87 of the outer bag and the bottom sheet 79 of the inner bag have been compressed and sealed together. The key strip 83 and the lock strip 84 lie in the compressed areas, as shown.

Figure 10C:
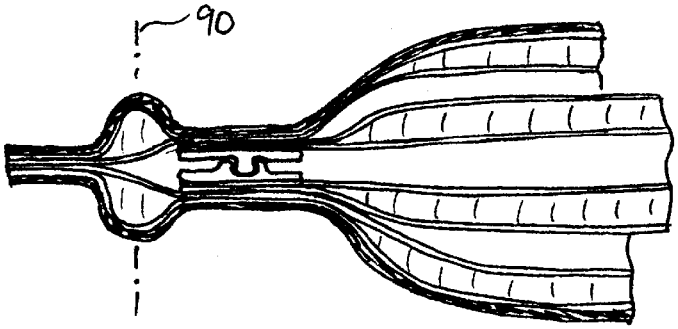

FIG. 10*c* shows the components when the bag has been sealed, ready for transit. The extensions 89 of the outer bag have been compressed and sealed together.

After transit, the recipient opens the bag 75 by cutting the material of the bag (with scissors) along the line indicated at 90. Now, the inner bag 76 remains sealed with the press-lock fastener 80. The recipient can pry the press-lock fastener apart, in order to get at the contents in the inner bag. However, the recipient can then relock the inner bag, by remaking the press-lock fastener.

The thermal barrier provided by the press-lock fastener is considerably less insulative than the thermal barrier provided by the welded-together extensions 89. However, the recipient now has the delivered articles in his possession, and he can keep the articles refrigerated, for such periods as may be required. The press-locked transit bag 75 serves as an excellent means for carrying the articles about, and keeping them handy, and maintains adequate short-period insulation.

As mentioned above, the inner layer, i.e. the piece of material that lines the inner bag, preferably is of aluminum foil. Aluminum foil is preferred because of its mechanical robustness, whereby the possibility of the layer being damaged by the insertion of the article, even by a careless person, is minimal. By contrast, if no inner layer were provided at all, i.e. if the inside of the inner bag were constituted by the bubbles themselves, that would hardly be satisfactory from the robustness standpoint, because the bubbles might be snagged by the article as the article was being inserted into the inner bag.

However, aluminum foil is expensive, and the special shaping of the foil, to ensure that the foil is not present in the marginal edges of the inner bag, only adds to the expense. The designer might therefore wish to compromise on the robustness, and go with plastic film as the inner layer. Apart from plastic being cheaper, now it is not so important to keep a plastic film out of the marginal areas, as it was with the metal foil. Also, a bag with a plastic inner layer can be expected to be a little more insulative, with cold articles, than a bag with a metal inner layer. If the bag is used for the transit of articles that have to be kept at a warm temperature, on the other hand, a metal inner liner can improve insulativeness, by preventing the escape of heat from the article by radiation. For warm articles, strictly from the isnsulation standpoint, the inner layer mgith be of metal and the outer liner of plastic: however, the outer layer must be of metal, even when the articles need to be kept warm than kept cold, for robustness reasons. Besides, the application of the transit bag as described herein is mainly to the fields of articles that are to be kept at temperatures below ambient, rather than above ambient.

The inflation of the space or cavity between the inner bag and the outer bag is preerred because of the extra insulatoive qualities of the still air thus introduced, and vbecause of the extra mechanical robustness. Inflation holds the bags apart, and the less the inner bag touches the outer bag, the less the heat transmission therebetween. From the robustnmess standpoint, the protection given by inflation does not benefiot only the article, but benefits the bubblkes themselves. Without inflation, it would be much more possible for the bubbles to be compressed, and perhaps even to be damaged, by rough handling. The bubbles are at their most insulative when they are intact, and not touching anything.

The designs of transit-bag as described herein are aimed at making it possible to transport such things as temperature-sensitive medicines by ordinary courier services, more or less anywhere in the world. It is recognised that bubblewrap material, though very common, is generally not used for thermal insulation. The bubbles themselves are good insulators, but the areas between the bubbles are not. So, for a thermal application, the areas between the bubbles have to be prevented from transmitting heat. Generally, the designer would infer that a good many layers of bubble-wrap material would be required for good insulation performance. The designs as described herein show how the (inexpensive) bubble-wrap material can be used for thermal insulation purposes. Its natural limitations in that direction are ameliorated by the arrangement of the material in the manner as described.

I claim:

1. An insulated transit-bag for containing a temperature-sensitive article for transport, wherein:

the transit-bag includes an inner-bag and an outer-bag, made from bubble-wrap;

the inner-bag is physically attached inside the outer-bag in such manner as to create a between-bags-cavity, the outside of which is defined by the inside of the outer-bag and the inside of which is defined by the outside of the inner-bag;

the inner-bag and the outer-bag have respective mouths;

the transit-bag is so structured that the mouth of the inner-bag lies open, and accessible for the placement of the article inside the inner-bag;

the transit-bag includes an operable bag-sealing-means, which is effective, upon being operated after the article is placed in the inner-bag:

(a) to leave the inner-bag as a substantially airtight enclosure with the article sealed inside;

(b) to leave the outer-bag as a substantially airtight enclosure with the inner-bag sealed inside;

(c) to leave the between-bags-cavity as a substantially airtight enclosure;

the outer-bag has an outward-facing-surface, and the transit-bag includes an outer-layer of a relatively strong film material, and the outer-layer is secured to the outward-facing-surface of the bubble-wrap from which the outer-bag is made;

the outer-layer is of such extent as to substantially completely cover the outwards-facing-surface of the outer-bag.

2. The insulated transit-bag as in claim 1, wherein:

bubble-wrap is a plastic sheet material comprising a base-film of thin plastic film and a bubble-film of thin plastic film;

bubble-wrap includes bubble-areas and between-bubbles-areas;

in the between-bubbles-areas of the bubble-wrap, non-bubble areas of the bubble-film lie in adhering face-to-face contact with corresponding non-bubble areas of the base-film;

in the bubble-areas of the bubble-wrap, bubble-roofs of the bubble-film lie spaced from, and separated from, corresponding bubble-floors of the base-film;

the bubble-film includes bubble-side-walls, which extend between the non-bubble-areas of the bubble-film and the bubble-roofs of the bubble-film, and which define bubbles of trapped air between the base-film and the bubble-film;

the bubble-film lies to a bubble-side of the bubble-wrap, and the base-film lies to a base-side of the bubble-wrap.

3. The insulated transit-bag as in claim 2, wherein the outer-layer outside the outer-bag is aluminum foil.

4. The insulated transit-bag as in claim 2, wherein the bubble-wrap from which the outer-bag is made lies bubble-side inwards, base-film outwards, and the outer-layer is secured directly to the base-side of the bubble-wrap from which the outer-bag is made.

5. The insulated transit-bag as in claim 4, wherein the bubble-wrap from which the inner-bag is made lies base-side inwards.

6. The insulated transit-bag as in claim 2, wherein:

the transit-bag includes an inner-layer of relatively strong material, and the inner-layer comprises the inward-facing-surface of the inner-bag;

the inner-layer is of such extent as to cover the inward-facing-surface of the inner-bag over at least a major portion thereof.

7. The insulated transit-bag as in claim 6, wherein the inner-layer is of relatively thick plastic film.

8. The insulated transit-bag as in claim 6, wherein the inner-layer is of aluminum foil, and the inner-layer is limited in its extent, in that the inner-layer stops short of the marginal edges of the inner-bag.

9. The insulated transit-bag as in claim 2, wherein:

the mouths of the bags are defined by inner-bag-lips and outer-bag-lips respectively;

the outer-bag-lips surround and encircle, and are sealingly secured to, the inner-bag-lips;

whereby the between-bags-cavity is sealed, and whereby the mouth of the inner-bag is open;

and the operable bag-sealing-means is effective, when operated, to seal the mouth of the inner-bag.

10. The insulated transit-bag as in claim 2, wherein:

the inner-bag comprises an inner-bag-top-sheet and an inner-bag-bottom-sheet, made from bubble-wrap;

the outer-bag comprises an outer-bag-top-sheet and an outer-bag-bottom-sheet, made from bubble-wrap;

the said four sheets are positioned flat against each other, and on top of each other, in direct touching contact, thereby forming a stack of four sheets;

along the marginal side edges of the stack of four sheets, the sheets are collapsed and flattened, and sealingly secured, the inner sheets to each other and to the outer sheets above and below.

11. The insulated transit-bag as in claim 2, wherein:

the transit bag includes a first operable means for closing the mouth of the outer bag, and a second operable means for closing the mouth of the inner bag;

the two means are separate in the sense that the means for closing the mouth of the outer bag can be detached and removed from the transit bag, leaving the means for closing the inner bag still intact and operable.

12. The insulated transit-bag as in claim 11, wherein the means for closing the inner bag comprises a press-lock strip fastener.

13. The insulated transit-bag as in claim 2, wherein the transit bag includes an operable inflation-means, for inflating the between-the-bags cavity with pressurised air, and for sealing the cavity closed, with pressurised air trapped inside.

14. The insulated transit-bag as in claim 13, wherein:

the inflation-means comprises a tube of plastic material;

the tube connects the between-the-bags cavity with the outside;

the inflation-means, when operated, is effective to pass outside air into the cavity.

15. The insulated transit-bag as in claim 14, wherein the tube is so arranged in relation to the bag-sealing-means that operation of the bag-sealing-means to seal the mouth of the bag is effective also to seal the tube.

16. The insulated transit-bag as in claim 15, wherein the tube comprises two strips of plastic film, laid flat upon each other, which are adhered to each other over marginal edges thereof, but are not adhered over a central strip thereof.

* * * * *